US009644574B2

(12) United States Patent
Guidi et al.

(10) Patent No.: US 9,644,574 B2
(45) Date of Patent: May 9, 2017

(54) EGR DEVICE HAVING BAFFLE AND EGR MIXER FOR EGR DEVICE

(71) Applicants: DENSO International America, Inc., Southfield, MI (US); DENSO CORPORATION, Kariya, Aichi-pref. (JP)

(72) Inventors: Paolo Guidi, Macomb, MI (US); Jude Dahl, Melvindale, MI (US)

(73) Assignee: DENSO International America, Inc., Southfield, MI (US)

( * ) Notice: Subject to any disclaimer, the term of this patent is extended or adjusted under 35 U.S.C. 154(b) by 170 days.

(21) Appl. No.: 14/556,718

(22) Filed: Dec. 1, 2014

(65) Prior Publication Data

US 2016/0153403 A1 Jun. 2, 2016

(51) Int. Cl.

| | |
|---|---|
| ***F02B 47/08*** | (2006.01) |
| ***F02M 25/07*** | (2006.01) |
| ***F02D 9/12*** | (2006.01) |
| ***F02M 26/19*** | (2016.01) |
| ***F02M 26/21*** | (2016.01) |
| *F02M 35/10* | (2006.01) |
| *F02M 26/06* | (2016.01) |
| *F02M 26/23* | (2016.01) |

(52) U.S. Cl.

CPC ..... *F02M 25/0722* (2013.01); *F02D 9/12* (2013.01); *F02M 25/0717* (2013.01); *F02M 26/19* (2016.02); *F02M 26/21* (2016.02); *F02M 35/10222* (2013.01); *F02M 35/10255* (2013.01); *F02M 26/06* (2016.02); *F02M 26/23* (2016.02); *F02M 35/10262* (2013.01)

(58) Field of Classification Search

CPC .. F02M 35/10222; F02M 26/19; F02M 26/21; F02M 35/10262

USPC ..... 123/568.17

See application file for complete search history.

(56) References Cited

U.S. PATENT DOCUMENTS

| | | | | |
|---|---|---|---|---|
| 2002/0088443 | A1 | 7/2002 | Marthaler et al. | |
| 2002/0158151 | A1* | 10/2002 | Fischer | F02M 35/10118 239/427 |
| 2003/0072660 | A1* | 4/2003 | Lawson | F04B 39/0027 417/569 |
| 2007/0256413 | A1* | 11/2007 | Marsal | F02M 26/05 60/605.2 |
| 2007/0271920 | A1 | 11/2007 | Marsal et al. | |
| 2011/0017934 | A1* | 1/2011 | Zui | F02M 26/69 251/321 |

(Continued)

FOREIGN PATENT DOCUMENTS

| | | |
|---|---|---|
| CN | 102182586 A | 9/2011 |
| DE | 102008036239 A | 2/2010 |

(Continued)

*Primary Examiner* — Hung Q Nguyen
*Assistant Examiner* — Charles Brauch

(57) ABSTRACT

An EGR device includes a housing and a baffle. The housing has an outer pipe and a wall. The wall extends radially inward from an end of the outer pipe. The outer pipe defines an EGR inlet. The baffle is accommodated in the outer pipe. The baffle includes an inner pipe defining an inner passage internally and defining an annular passage externally with the outer pipe. The annular passage is configured to communicate with the EGR inlet. The housing has at least one diffuser extending from the wall. The at least one diffuser is located in the annular passage.

16 Claims, 11 Drawing Sheets

(56) References Cited

U.S. PATENT DOCUMENTS

| | | | | |
|---|---|---|---|---|
| 2012/0180478 | A1 | 7/2012 | Johnson et al. | |
| 2012/0204845 | A1* | 8/2012 | Gingrich ..... | F02M 26/43<br>123/568.17 |

FOREIGN PATENT DOCUMENTS

| | | | |
|---|---|---|---|
| EP | 0887541 | A2 | 12/1998 |
| WO | 02055866 | A1 | 7/2002 |
| WO | 2013-055361 | A1 | 4/2013 |

* cited by examiner

EGR DEVICE HAVING BAFFLE AND EGR MIXER FOR EGR DEVICE

TECHNICAL FIELD

The present disclosure relates to an EGR device having a baffle for an internal combustion engine of a vehicle. The present disclosure further relates to an EGR mixer for the EGR device.

BACKGROUND

A vehicle may be equipped with an exhaust gas recirculation system (EGR system). The EGR system is to reduce emission contained in exhaust gas discharged from an internal combustion engine. The EGR system may recirculate a part of exhaust gas into fresh air to produce mixture gas containing recirculated exhaust gas and fresh air. Recirculated exhaust gas may be unevenly mixed with fresh air to reduce combustion efficiency of the engine consequently.

SUMMARY

The present disclosure addresses the above-described concerns.

According to an aspect of the preset disclosure, an EGR device comprises a housing having an outer pipe and a wall. The wall extends radially inward from an end of the outer pipe. The outer pipe defines an EGR inlet. The EGR device further comprises a baffle accommodated in the outer pipe. The baffle includes an inner pipe defining an inner passage internally and defining an annular passage externally with the outer pipe. The annular passage is configured to communicate with the EGR inlet. The housing has at least one diffuser extending from the wall. The at least one diffuser is located in the annular passage.

According to another aspect of the preset disclosure, an EGR device comprises a housing having an outer pipe and a wall. The wall extends radially inward from an end of the outer pipe. The outer pipe defines an EGR inlet. The EGR device further comprises a baffle accommodated in the outer pipe and movable in an axial direction. The baffle has an inner pipe located radially inside the outer pipe. The inner pipe defines an inner passage internally. The baffle has a brim extending radially inward from an end of the baffle. The housing has at least one diffuser extending from the wall. The inner pipe is located inside the outer pipe. The at least one diffuser is located inside the inner pipe.

According to another aspect of the preset disclosure, an EGR device comprises a housing having an outer pipe and a wall. The wall extends radially inward from an end of the outer pipe. The outer pipe defines an EGR inlet extending radially through the outer pipe. The EGR device further comprises a baffle accommodated in the outer pipe. The baffle includes an inner pipe configured to overlap with the EGR inlet radially and movable in an axial direction to manipulate an opening area of the EGR inlet, which is not overlapped with the baffle. The baffle is configured such that the opening area is substantially in proportion to a flow quantity of EGR gas passing through the opening area to regulate a flow velocity of EGR gas constantly at different flow quantities of EGR gas.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION (First Embodiment)

Figure 1:
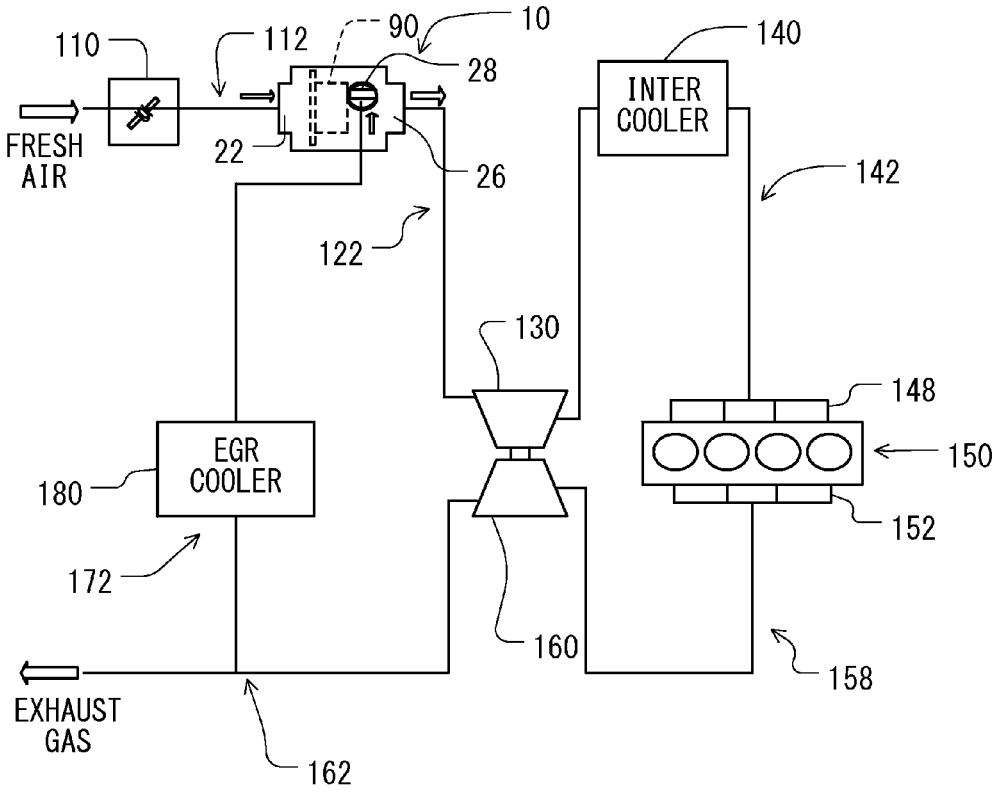
FIG. 1 is a block diagram showing an EGR system for an internal combustion engine of a vehicle.

In the following description, a radial direction is along an arrow represented by "RADIAL" in drawing(s). An axial direction is along an arrow represented by "AXIAL" in drawing(s). A circumferential direction is along an arrow represented by "CIRCUMFERENTIAL" in drawing(s). A vertical direction is along an arrow represented by "VERTICAL" in drawing(s). A horizontal direction is along an arrow represented by "HORIZONTAL" in drawing(s). A flow direction is along an arrow represented by "FLOW" in drawing(s).

As follows, a first embodiment of the present disclosure will be described with reference to FIGS. 1 to 9. As shown FIG. 1, according to the present example, an internal combustion engine 150 has four cylinders connected with an intake manifold 148 and an exhaust manifold 152.

The engine 150 is combined with an intake and exhaust system. The intake and exhaust system includes an intake valve 110, an intake passage 112, an EGR device 10, a mixture passage 122, a turbocharger including a compressor 130 and a turbine 160, a charge air passage 142, and an intercooler 140. The intake and exhaust system further includes a combustion gas passage 158, an exhaust passage 162, an EGR passage 172, and an EGR cooler 180.

The intake passage 112 is equipped with the intake valve 110. The intake passage 112 is connected with an air inlet 22 of the EGR device 10. The EGR device 10 includes an outlet 26 connected with the compressor 130 through the mixture passage 122. The compressor 130 is connected with the intake manifold 148 through the charge air passage 142. The charge air passage 142 is equipped with the intercooler 140. The exhaust manifold 152 is connected with the turbine 160 through the combustion gas passage 158. The turbine 160 is connected with the exhaust passage 162. The EGR passage 172 is branched from the exhaust passage 162 and connected with an EGR inlet 28 of the EGR device 10. The EGR passage 172 is equipped with the EGR cooler 180.

The intake passage 112 conducts fresh air from the outside of the vehicle through the intake valve 110 into the EGR device 10. The intake valve 110 regulates a quantity of fresh air flowing through the intake passage 112 into the EGR device 10. The EGR device 10 draws fresh air from the intake passage 112 and draws exhaust gas from the exhaust passage 162 through the EGR passage 172. The EGR device 10 includes an EGR mixer to blend the drawn fresh air with the drawn exhaust gas to produce mixture gas. The mixture passage 122 conducts the mixture gas from the EGR device 10 into the compressor 130.

The compressor 130 is rotatably connected with the turbine 160 via a common axis. The compressor 130 is driven by the turbine 160 to compress the mixture gas. The charge air passage 142 conducts the compressed mixture gas to the intake manifold 148. The intercooler 140 is a heat exchanger to cool the compressed mixture gas conducted through the charge air passage 142.

The engine 150 draws the cooled mixture gas. The engine 150 forms air-fuel mixture with the drawn mixture gas and injected fuel in each cylinder and burns the air-fuel mixture in the cylinder to drive a piston in the cylinder. The engine 150 emits combustion gas (exhaust gas) through the exhaust manifold 152 into the combustion gas passage 158. The combustion gas passage 158 conducts the combustion gas into the turbine 160. The turbine 160 is driven by the exhaust gas to drive the compressor 130 thereby to cause the compressor 130 to compress mixture gas and to press-feed the compressed mixture gas through the charge air passage 142 and the intercooler 140 into the engine 150.

The exhaust passage 162 conducts exhaust gas (combustion gas) from the turbine 160 to the outside of the vehicle. The EGR passage 172 is branched from the exhaust passage 162 at the downstream side of the turbine 160 to recirculate a part of exhaust gas from the exhaust passage 162 into the EGR device 10. The EGR cooler 180 is a heat exchanger to cool exhaust gas flowing though the EGR passage 172 into the EGR device 10. The EGR device 10 is located at a connection among the intake passage 112, the EGR passage 172, and the mixture passage 122. The EGR passage 172 is merged with the intake passage 112 in the EGR device 10. The EGR device 10 includes a baffle 50 to regulate a quantity of EGR gas recirculated into the EGR mixer.

As described above, the EGR system is configured to recirculate a part of exhaust gas from the exhaust passage 162 into the intake passage 112. The circulated exhaust gas may contain oxygen at a lower percentage compared with oxygen contained in fresh air. Therefore, circulated exhaust gas may dilute mixture of exhaust gas and fresh air thereby to reduce peak temperature of combustion gas when burned in the combustion chamber of the engine 150. In this way, the EGR system may reduce oxidization of nitrogen, which is caused under high temperature, thereby to reduce nitrogen oxide (NOx) occurring in the combustion chamber.

Figure 2:
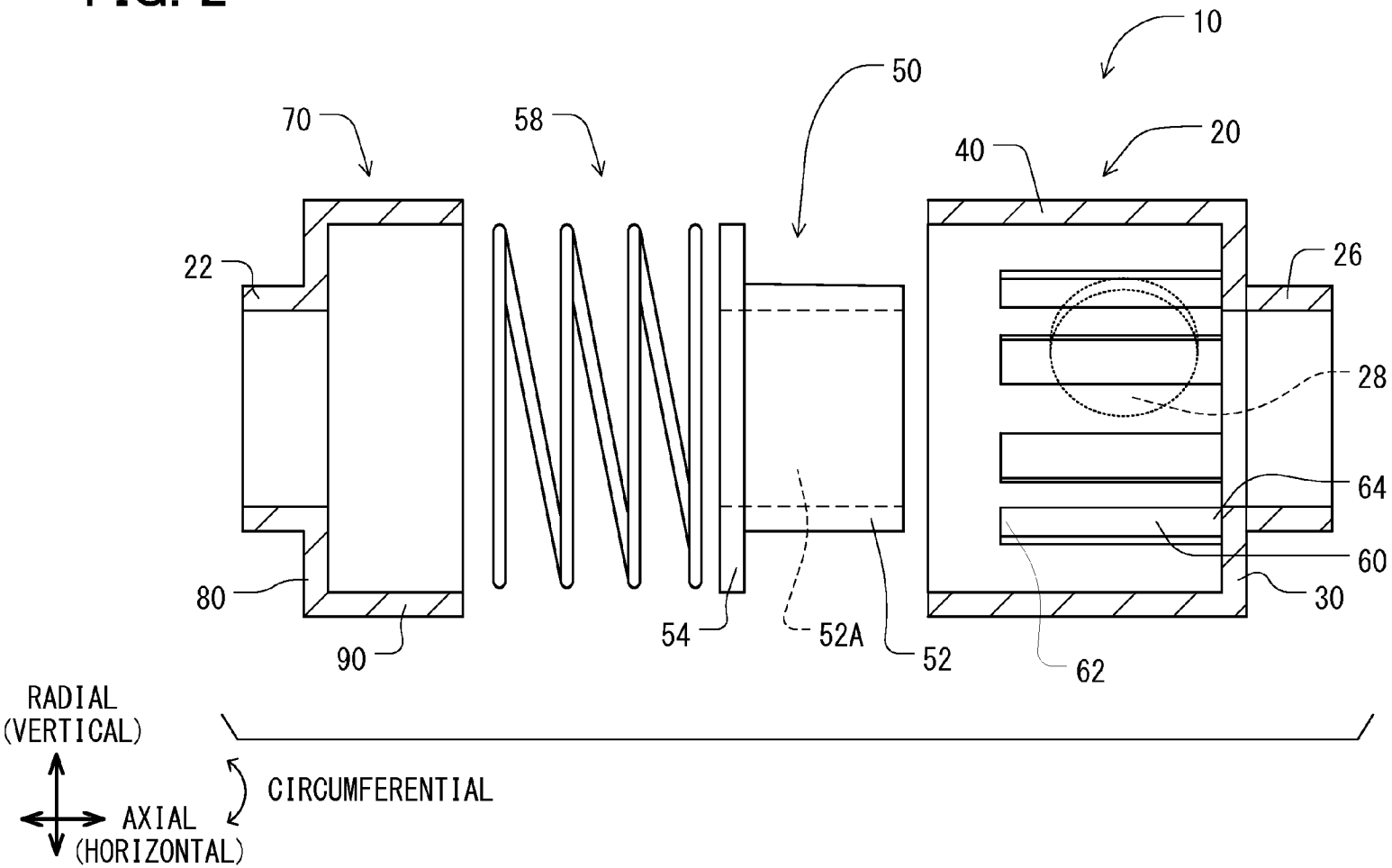
FIG. 2 is an exploded view showing components of an EGR device for the EGR system, according to a first embodiment.

Subsequently, the configuration of the EGR device 10 will be described in detail. As shown in FIG. 2, the EGR device 10 includes an end cap 70, a spring 58, an baffle 50, and a housing 20, which are formed of a metallic material such as stainless steel and/or aluminum alloy.

The end cap 70 includes a cap body 90, a seat 80, and the air inlet 22, which are concentric with each other and are integrally formed. The cap body 90 is in a tubular shape. The seat 80 is in a disc shape extending radially inward from one end of the cap body 90. The seat 80 forms a spring seat at one side. The air inlet 22 is in a tubular shape and extending from an opening of the seat 80.

The spring 58 is a coil spring having the outer diameter smaller than the inner diameter of the cap body 90 and the inner diameter of the outer pipe 40. The spring 58 is resiliently compressive and expandable in the axial direction.

The baffle 50 includes an inner pipe 52 and a brim 54, which are concentric with each other and are integrally formed. The inner pipe 52 is in a tubular shape and defines an inner passage 52*a* internally. The inner passage 52*a* is a through hole extending though the inner pipe 52 in the axial direction. The brim 54 is in a disc shape extending radially outward from one end of the inner pipe 52. The brim 54 forms a spring seat at one side and defines a part of a pressure chamber 20A at the other side.

The housing 20 includes an outer pipe 40, a wall 30, and the outlet 26, which are concentric with each other and are integrally formed. The outer pipe 40 is in a tubular shape. The wall 30 is in a disc shape extending radially inward from one end of the outer pipe 40. The wall 30 defines the pressure chamber 20A at one side. The outlet 26 is in a tubular shape and extended from an opening of the wall 30. The housing 20 further includes multiple diffusers 60 projected in the axial direction from the wall 30 into the interior of the housing 20. The diffusers 60 are each being in a strip shape and cantilevered on the wall 30 at one end (fixed end) 64 and are free at the other end (free end) 62. The diffusers 60 are arranged in the circumferential direction at constant angular intervals. The housing 20 has the EGR inlet 28, which is a through hole extending radially through the outer pipe 40 to communicate the interior of the housing 20 with the exterior of the housing 20. The housing 20 may function as an EGR mixer.

The end cap 70, the spring 58, the baffle 50, and the housing 20 are coaxially assembled into one component. Specifically, the baffle 50 is inserted through an opening of the housing 20 into the interior of the housing 20. The spring 58 is accommodated in the end cap 70. In the present state, the end cap 70 is coupled with the housing 20 to form the EGR device 10 and to accommodate the spring 58 and the inner pipe 52.

Figure 3:
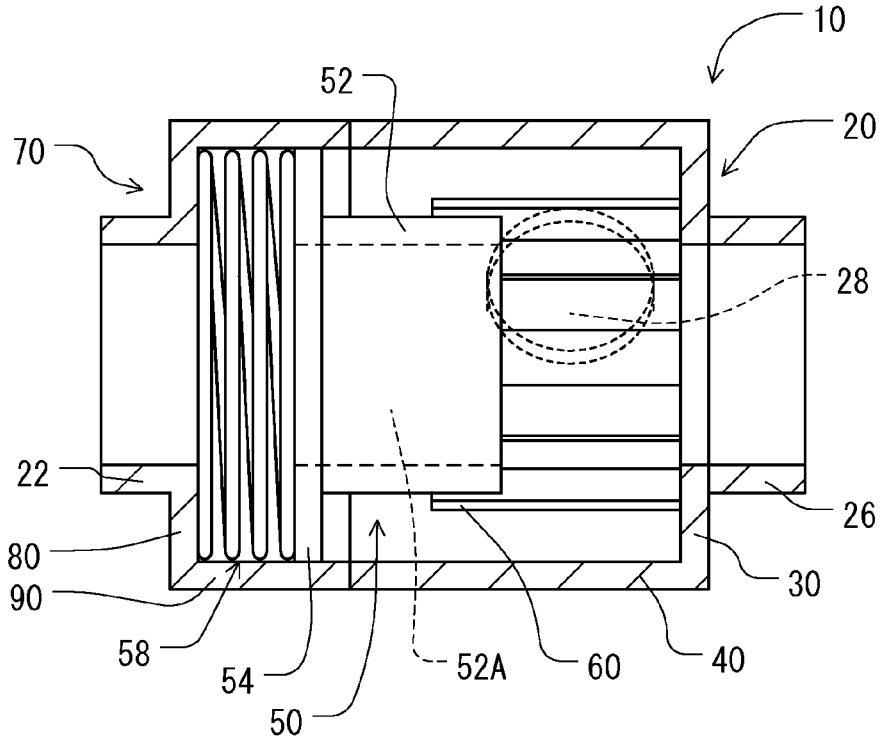
FIGS. 3 and 4 are sectional views showing the EGR device at a full open position and at a full close position.
Figure 3:
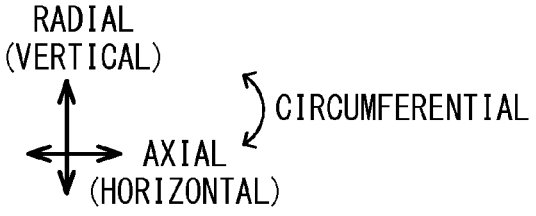
Figure 4:
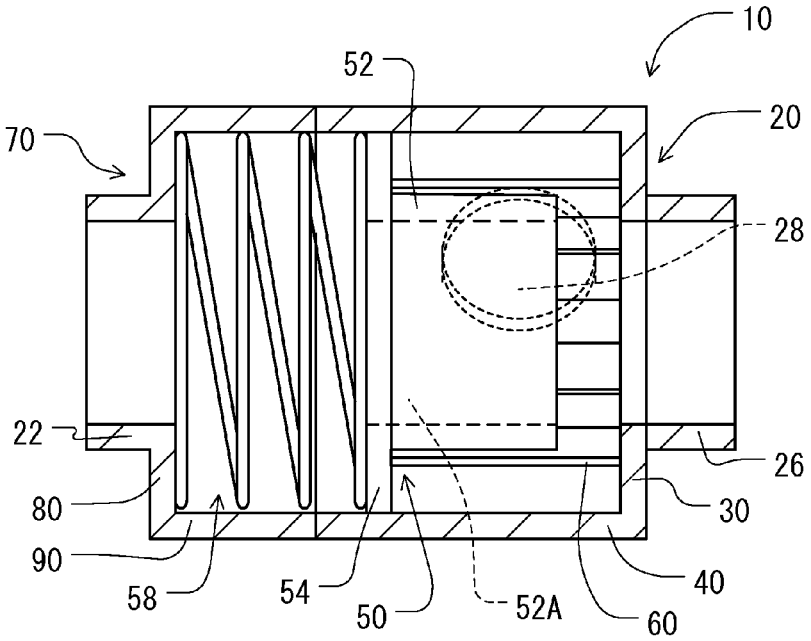
Figure 4:
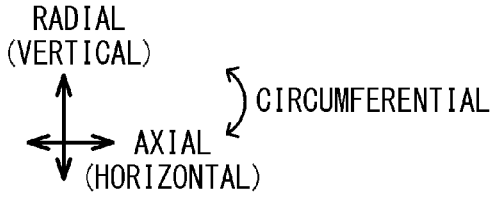

FIGS. 3 and 4 show the EGR device 10 as assembled. The EGR device 10 forms an internal passage passing through the air inlet 22, the interior of the end cap 70, the inner passage 52*a*, the interior of the housing 20, and the outlet 26 along the axial direction. The EGR device 10 draws fresh air into the air inlet 22 to pass through the inner passage 52*a*. The EGR device 10 draws EGR gas into the EGR inlet 28 and mixes the EGR gas with the fresh air inside the housing 20 to produce EGR mixture. The EGR device 10 discharges the EGR mixture through the outlet 26.

The brim 54 of the baffle 50 has the outer diameter slightly smaller than the inner diameters of the inner peripheries of the cap body 90 and the outer pipe 40. The brim 54 is slidable along the inner peripheries of the cap body 90 and the outer pipe 40. Thus, the baffle 50 is movable in the axial direction inside the cap body 90 and the outer pipe 40. The baffle 50 is movable in an open direction toward a full open position in FIG. 3 and movable in a close direction toward a full close position in FIG. 4. The spring 58 is interposed between the seat 80 of the end cap 70 and the brim 54 of the baffle 50 to bias the baffle 50 toward the full close position on the side of the outlet 26.

FIG. 3 shows the EGR device 10 in the full open position. In the present state, the baffle 50 moves toward the air inlet 22 to compress the spring 58 between the seat 80 and the brim 54. In the present state, the brim 54 is apart from the free ends 62 of the diffusers 60. The inner pipe 52 is slightly overlapped with the EGR inlet 28 to widely open the EGR inlet 28 and to enable a large quantity of EGR gas to flow through the EGR inlet 28.

FIG. 4 shows the EGR device 10 in the full close position. In the present state, the brim 54 is biased from the spring 58 at one end and is in contact with the free ends 62 of the diffusers 60 at the other end. Thus, the free ends 62 of the diffusers 60 retains the baffle 50 in the full close position. The inner pipe 52 is widely overlapped with the EGR inlet 28 to regulate the quantity of EGR gas flowing through the EGR inlet 28.

Figure 5:
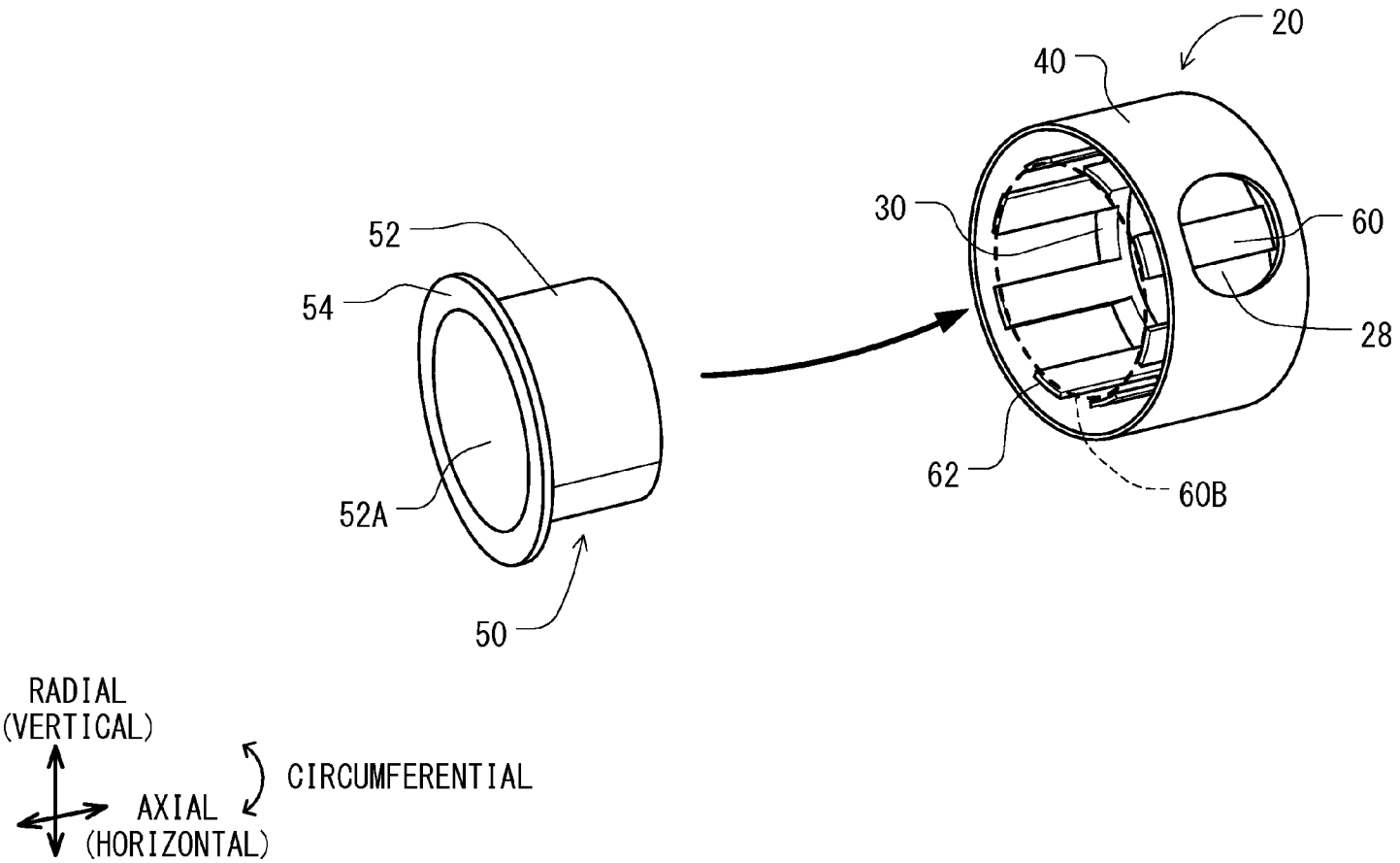
FIG. 5 is an exploded perspective view showing a baffle and a housing of the EGR device.

FIG. 5 shows the baffle 50 to be inserted into the housing 20. In the housing 20, the diffusers 60 are arranged in the circumferential direction at constant angular intervals. In the present example, the housing 20 includes eight diffusers 60 arranged at 45-degree angular intervals. The diffusers 60 form an circular array inside the outer pipe 40. Each of the diffusers 60 has a thick arc-shaped cross section. The thick arc-shaped cross sections of the diffusers 60 are arranged along an imaginary circle 60B. Diffusers 60 define slits 60A therebetween in the circumferential direction.

Figure 6:
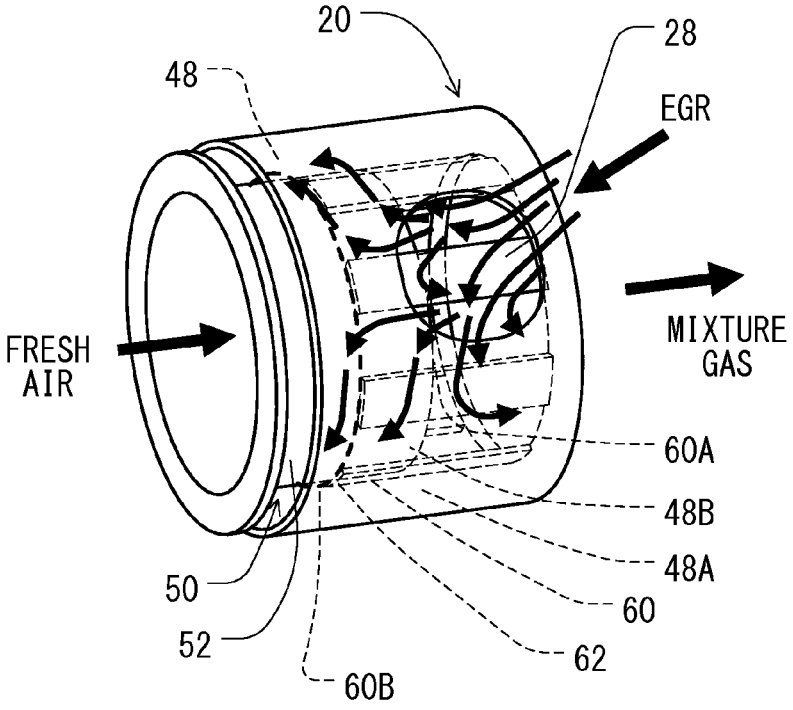
FIGS. 6 and 7 are perspective views showing the baffle in the housing in the full open position and in the full close position.
Figure 6:
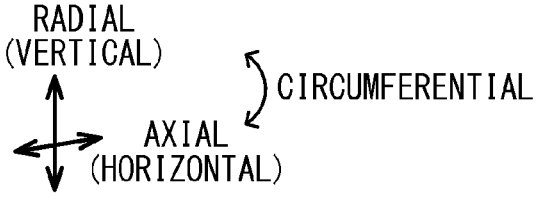

FIG. 6 shows the baffle 50 inserted in the housing 20 and in the full open position. The inner pipe 52, the circular array of the diffusers 60, and the outer pipe 40 are concentrically aligned and are arranged radially in this order from the inside toward the outside in the radial direction. The outer periphery of the inner pipe 52 and the inner periphery of the outer pipe 40 form an annular passage 48 therebetween. The circular array of the diffusers 60 divides the annular passage 48 into an outer channel 48A an inner channel 48B. Specifically, the outer channel 48A is defined between the imaginary circle 60B and the inner periphery of the outer pipe 40. The inner channel 48B is defined between the outer periphery of the inner pipe 52 and the imaginary circle 60B.

In the state of FIG. 6, the free ends 62 of the diffusers 60 and the brim 54 form a part of the annular passage 48 between the outer pipe 40 and the inner pipe 52. The outer channel 48A communicates with the inner channel 48B radially inward through the slits 60A and the part of the annular passage 48. As shown by the arrows, EGR gas flows through the EGR inlet 28 into the annular passage 48. The EGR gas further flows through the outer channel 48A, the slits 60A, and the inner channel 48B into the interior of the housing 20. One of the diffusers 60 is faced to the EGR inlet 28 to obstruct the flow of EGR gas and to deflect the flow of the EGR gas axially and circumferentially on the diffuser 60. The EGR inlet 28, the one diffuser 60, and the inner pipe 52 are overlapped one another in the radial direction. More specifically, in the full open state, the inner pipe 52 is overlapped with the EGR inlet 28 slightly to form a wide opening to communicate the EGR inlet 28 with the interior of the housing 20.

The deflected EGR gas flows circumferentially along the outer channel 48A and flows radially inward through the slits 60A into the inner channel 48B. The deflected EGR gas flows axially into the part of the annular passage 48 and flows into the inner channel 48B to flow along the inner pipe 52. Thus, the flow of EGR gas is divided into multiple stream lines and ultimately directed into the interior of the housing 20. In this way, the diffusers 60 and the inner pipe 52 causes turbulence in the EGR gas to diffuse the EGR gas into fresh air conducted through the inner passage 52*a* of the inner pipe 52. In addition, the inner pipe 52 conducts the EGR gas to flow to the radially opposite side of the inner pipe 52 from the EGR inlet 28.

Figure 7:
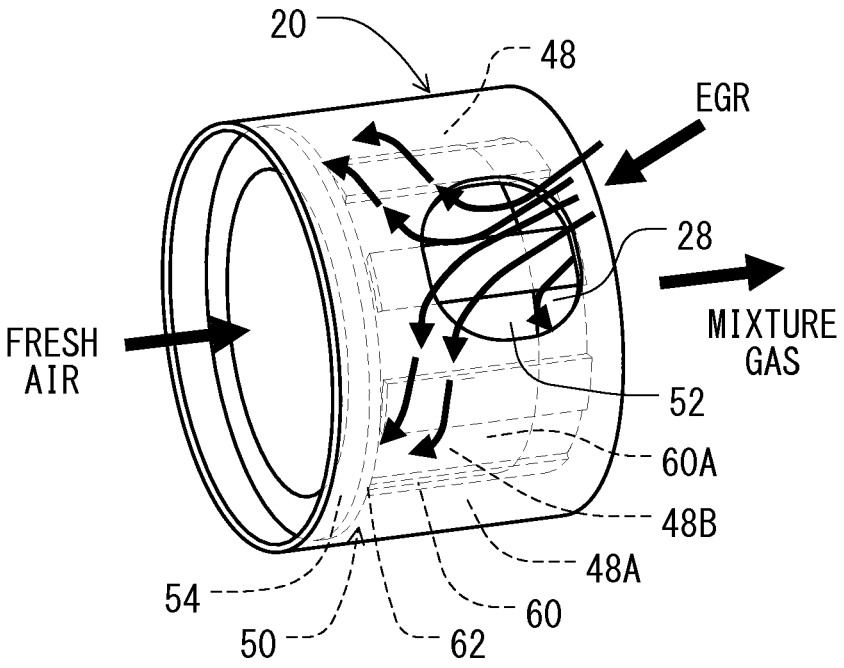
Figure 7:
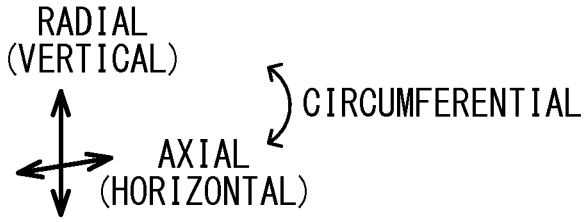

FIG. 7 shows the baffle 50 in the full close position. In the full close position, the free ends 62 of the diffusers 60 are in contact with the brim 54 of the baffle 50 not to form the part of the annular passage 48 between the free ends 62 and the brim 54. The outer channel 48A communicates with the inner channel 48B through the slits 60A. As shown by the arrows, EGR gas flows through the outer channel 48A, the slits 60A, and the inner channel 48B into the interior of the housing 20. In the full close state, the inner pipe 52 are overlapped with the EGR inlet 28 largely to form a small opening to communicate the EGR inlet 28 with the interior of the housing 20.

In the full close state, the diffusers 60 deflects EGR gas and to flow the deflected EGR gas circumferentially along the outer channel 48A and to flow radially inward through the slits 60A into the inner channel 48B. In this way, the diffusers 60 and the inner pipe 52 also causes turbulence in the EGR gas to diffuse the EGR gas into fresh air. In addition, the inner pipe 52 conducts the EGR gas to flow to the radially opposite side of the inner pipe 52 from the EGR inlet 28.

Figure 8:
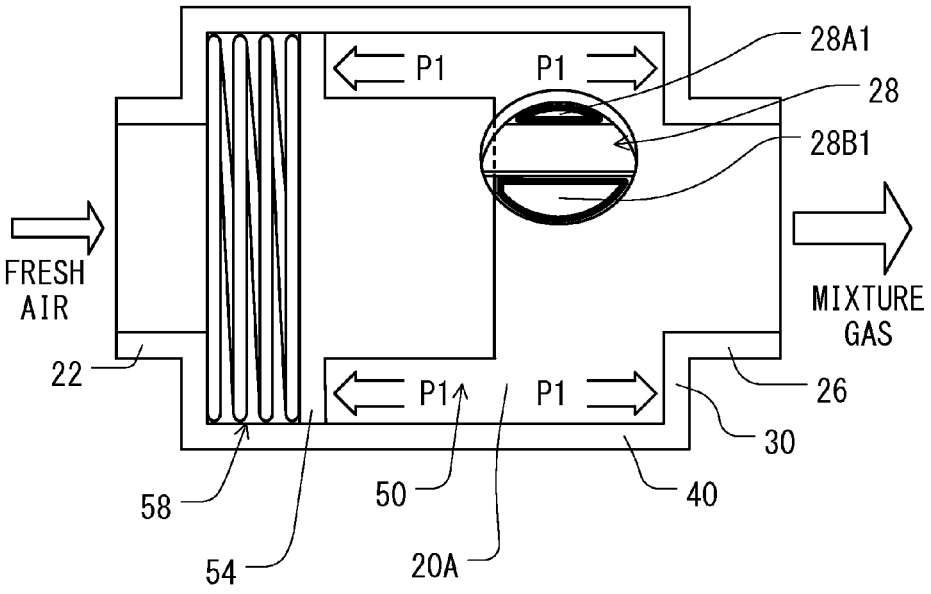
FIGS. 8 and 9 are schematic views showing the baffle in the housing in the full open position and in the full close position.
Figure 8:
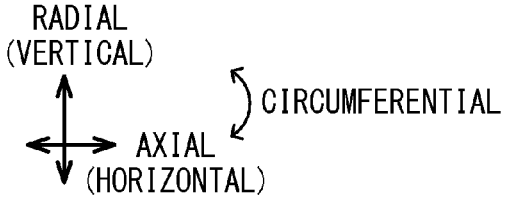
Figure 9:
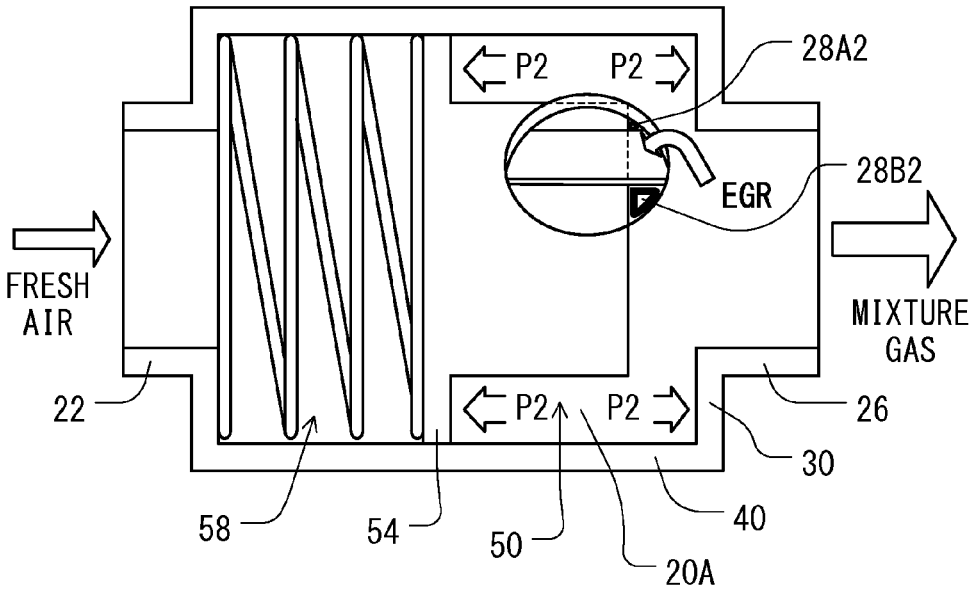
Figure 9:
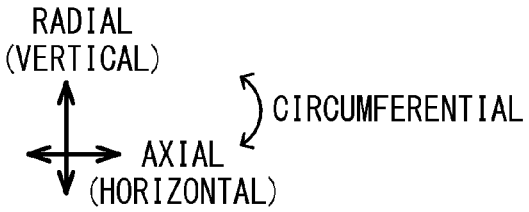

As shown in FIGS. 8 and 9, the brim 54 of the baffle 50, the outer pipe 40 of the housing 20, and the wall 30 of the housing 20 form the pressure chamber 20A.

FIG. 8 shows the baffle 50 in the housing 20 and in the full open position. The inner pipe 52 and the one diffuser 60 form openings 28A1 and 28B1 radially communicating the EGR inlet 28 with the interior of the housing 20. The opening 28A1 has an area A1, and the opening 28B1 has an area B1. The EGR inlet 28 substantially has a total area AREA1=(A1+B1). In the present full open position, the EGR inlet 28 having a large total area (A1+B1) enables to flow a large quantity of EGR gas into the interior of the housing 20. The EGR gas causes a large pressure P1 applied to the brim 54 and the wall 30 in the axial direction to move the baffle 50 in the opening direction leftward in the drawing against resilience of the spring 58.

FIG. 9 shows the baffle 50 in the housing 20 and in the full close position. The inner pipe 52 and the one diffuser 60 form openings 28A2 and 28B2 radially communicating the EGR inlet 28 with the interior of the housing 20. The opening 28A2 has an area A2, and the opening 28B2 has an area B2. In the full close position, the EGR inlet 28 substantially has a total area AREA2=(A2+B2), which is less than the total area (A1+A2) in the full open position. In the present full close position, the EGR inlet 28 having a small total area (A2+B2) enables to flow a small quantity of EGR gas into the interior of the housing 20. The EGR gas causes a small pressure P2, which is less than P1, applied to the brim 54 and the wall 30 in the axial direction. In the present full close state, the resilience of the spring 58 moves the baffle 50 in the closing direction rightward in the drawing against the pressure P2.

The EGR device 10 has a configuration such that the total area of the EGR inlet 28 is substantially in proportion to a flow quantity of EGR gas. That is, when the flow quantity of EGR gas is, for example, doubled, the total area of the EGR inlet 28 is substantially doubled. In the state of FIG. 8, EGR gas flows through the openings 28A1 and 28B1, which have the AREA1=(A1+B1), at a velocity V1, and a flow quantity of EGR gas Q1 is calculated by Q1=(A1+B1)*V1. In the state of FIG. 9, EGR gas flows through the openings 28A2 and 28B2, which have the AREA2=(A2+B2), at the velocity V1 same as the velocity in FIG. 8, and a flow quantity of EGR gas Q2 is calculated by Q2=(A2+B2)*V1. The present configuration may enable to regulate the velocity at the constant value V1 at different flow quantities of EGR gas thereby to regulate penetration of the EGR gas flow constantly, regardless of variation in the flow quantity of EGR gas. Therefore, EGR gas is enabled to reach a constant target position in the pressure chamber 20A, regardless of variation in the flow quantity of EGR gas.

In the full open position in FIG. 8, the quantity of EGR gas flowing into the EGR inlet 28 is large to cause the large pressure P2 in the pressure chamber 20A to form the large total area (A1+B1). When the quantity of EGR gas is large, the flow of EGR gas passing through the large total area (A2+B2) may have a sufficient flow velocity. Therefore, a sufficient quantity of EGR gas may be enabled to reach the center of the interior of the housing 20. In the full close position in FIG. 9, a quantity of EGR gas flowing into the EGR inlet 28 is small to cause the small pressure P2 in the pressure chamber 20A to form the small total area (A2+B2). When the quantity of EGR gas is small, the small total area (A2+B2) throttles the flow of EGR gas to increase a flow velocity of EGR gas. In this way, even when the quantity of EGR gas is small, the small total area (A2+B2) may enable to flow EGR gas into the center of the interior of the housing 20.

When the flow quantity of EGR gas is large, the EGR gas causes the large pressure P1 in the pressure chamber 20A to widely open the EGR passage at the area (A1+B1). To the contrary, when the flow quantity of EGR gas is small, the EGR gas causes small pressure P2 in the pressure chamber 20A to move the baffle 50 toward the full close position and to throttle the EGR passage at the area (A2+B2). In this way, the EGR device 10 may have a self actuating configuration to actuate the baffle 50 according to the flow quantity of EGR gas into the EGR inlet 28.

As fresh air flows into the pressure chamber 20A, the flow of fresh air may apply a dynamic pressure onto the wall 30. As a quantity of fresh air increases, the dynamic pressure may also become large to increase pressure in the pressure chamber 20A. Thus, as the quantity of fresh air increases, the baffle 50 may move against resilience of the spring 58 to increase the opening of the EGR inlet 28 to induce a greater amount of EGR gas though the EGR inlet 28. To the contrary, as the quantity of fresh air decreases, the dynamic pressure may also become small to decrease pressure in the pressure chamber 20A. Thus, the baffle 50 may be moved by application of resilience of the spring 58 to reduce the opening of the EGR inlet 28 to induce a smaller amount of EGR gas though the EGR inlet 28. In this way, the EGR device 10 may actuate the baffle 50 to enable substantially constant entry of EGR gas into the EGR inlet 28 according to the flow quantity of fresh air.

(Second Embodiment)

Figure 10:
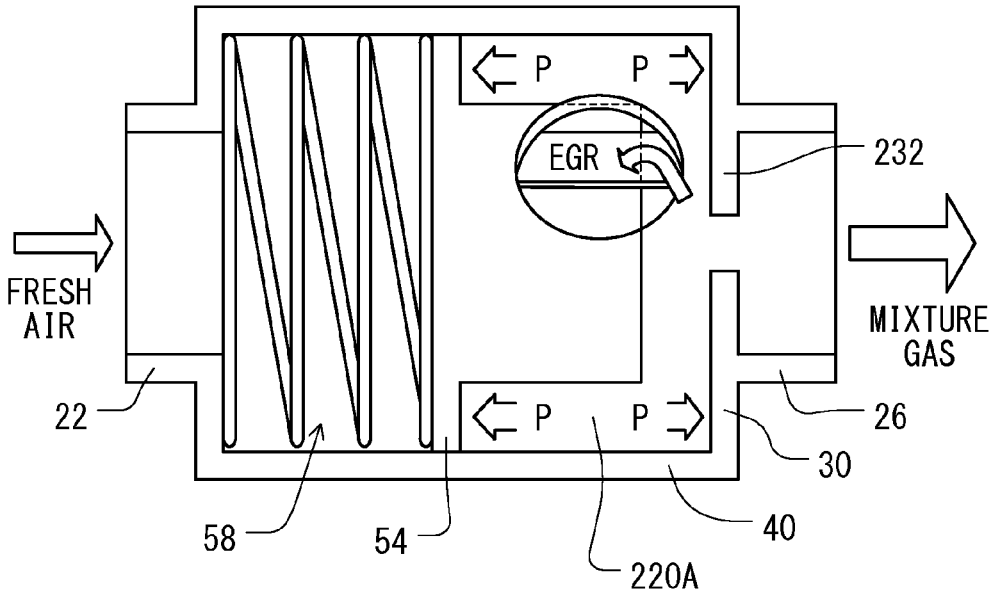
FIG. 10 is a schematic view showing an EGR device according to a second embodiment.
Figure 10:
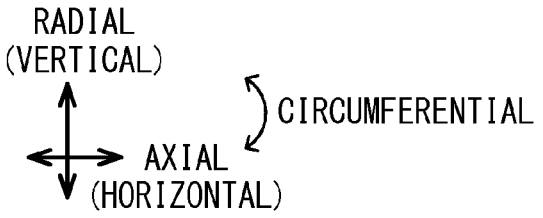

As shown in FIG. 10, according to the present second embodiment, the wall 30 is equipped with an inner wall 232. The inner wall 232*s* extend from the inner periphery of the wall 30 radially inward. The inner wall 232 may form a throttle between the interior of the housing 20 and the interior of the outlet 26. The inner wall 232 also forms a pressure chamber 220A together with the wall 30, the outer pipe 40, and the brim 54. The inner wall 232 may function to retain EGR gas entering through the EGR inlet 28 in the pressure chamber 220A to efficiently cause pressure P in the pressure chamber 220A. The present configuration may enhance response of the movement of the baffle 50 relative to change in pressure of EGR gas in the pressure chamber 220A.

(Third Embodiment)

Figure 11:
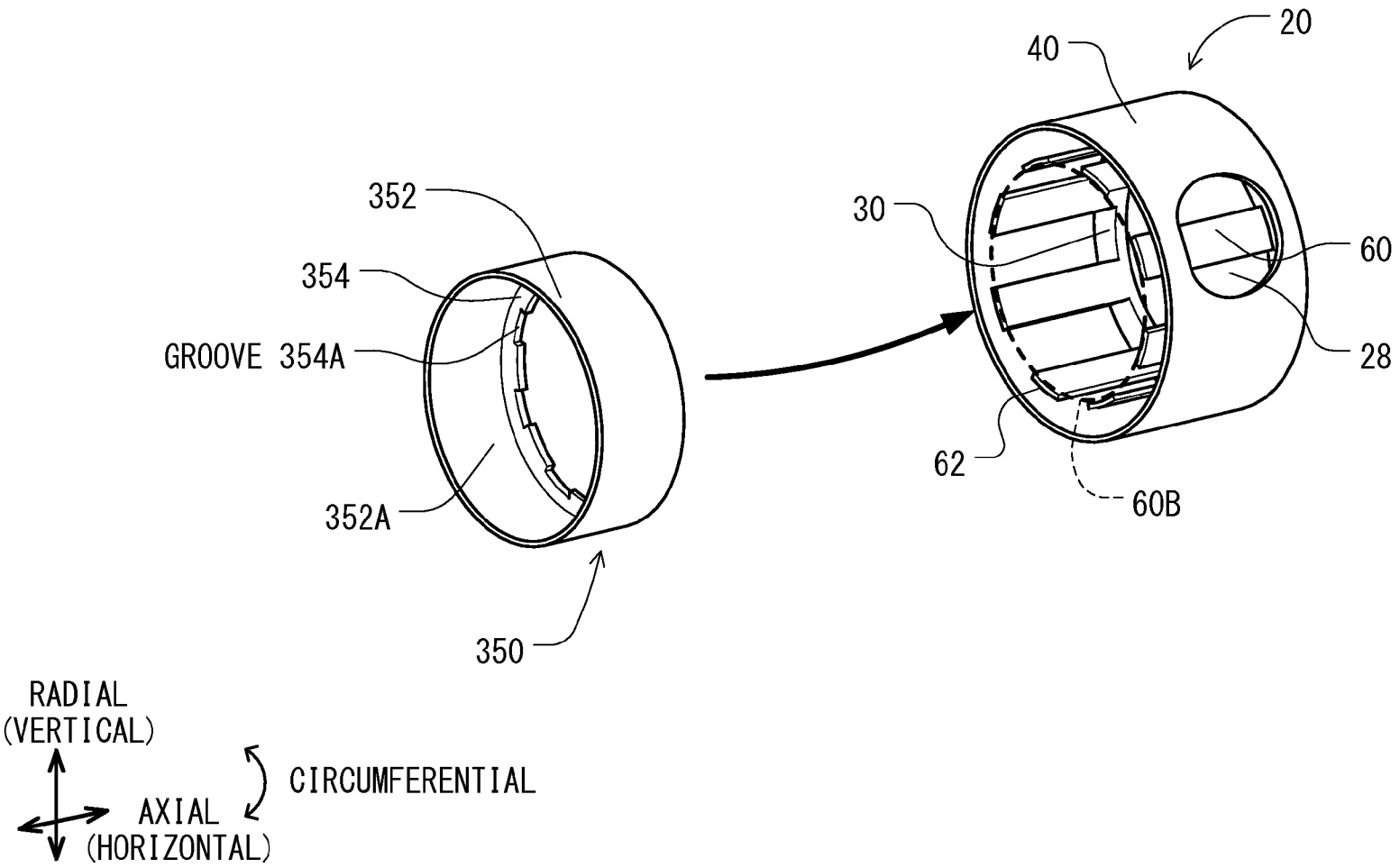
FIG. 11 is an exploded perspective view showing a baffle and a housing of the EGR device according to a second embodiment.

As shown in FIG. 11, according to the present second embodiment, a baffle 350 includes an inner pipe 352 and a brim 354, which are concentric with each other and are integrally formed. The inner pipe 352 is in a tubular shape and defines an inner passage 352*a* internally. The inner passage 52*a* is a through hole extending though the inner pipe 352 and the brim 354 in the axial direction. The brim 354 is in a disc shape extending radially inward from one end of the inner pipe 352. The brim 354 forms a spring seat at one side and defines a part of the pressure chamber 20A (FIGS. 8 and 9) at the other side, similarly to the first embodiment. The brim 354 has multiple grooves 354A notched and recessed radially outward. The grooves 354A are arranged in the circumferential direction at constant angular intervals corresponding to the circular allay of the diffusers 60.

The baffle 350 is coupled with the housing 20. More specifically, the grooves 354A are aligned with the diffusers 60 of the housing 20, and the housing 20 is inserted into the annular passage 48 in the axial direction. Thus, the brim 354 of the baffle 350 is movably fitted the diffusers 60 the housing 20.

The baffle 350 and the housing 20 are coupled with the spring 58 and the end cover (FIG. 2) similarly to the first embodiment. When the baffle 350 is accommodated in the housing 20, the diffusers 60 guides the grooves 354A of the baffle 350 to enable the baffle 350 to move in the housing 20 in the axial direction. The inner pipe 352 is slidable along the outer pipe 40 in the axial direction. The inner pipe 352 is located between the outer pipe 40 and the diffusers 60 in the radial direction. The inner pipe 352 is configured to be overlapped with one diffuser 60 and the outer pipe 40 to regulate the opening area of the EGR inlet 28.

(Other Embodiment)

The spring may be equipped between the baffle and the housing. More specifically, the spring may be equipped between the brim and the wall of the housing. In this case, the spring may be affixed to the brim and the wall at both ends. In the present configuration, when the baffle is moving toward the full open position, the brim and the wall are applied with large pressure to move away from each other, thereby to axially pull the spring at both ends resiliently to expand the spring. Alternatively, when the baffle is moving toward the full close position, the brim and the wall are applied with small pressure, and thus, the spring resiliently contracts to pull the brim and the wall axially inward at both ends.

The spring is not limited to the coil spring as exemplified and may be in another form such as an elastic rubber component.

The diffusers may employ various forms. For example, the diffusers may employ various numbers, various sizes, various arrangements, and/or various shapes. For example, the diffuser may employ various shapes such as a bar-shape. The diffuser may employ an inclined vane shape. In this case, the diffuser may be circumferentially arranged and inclined radially inward at one side in the circumferential direction.

The diffusers may be unevenly arranged. The outer pipe may have two or more EGR inlets. The circular array of the diffusers may be offset from the inner pipe and/or the outer pipe. The inner pipe may be offset from the circular array of the diffusers and/or the outer pipe. One of the diffusers on the upstream side of the EGR gas flow may be smaller in width than another of the diffusers. One of the slits on the upstream side of the EGR gas flow may be smaller than another of the slits on the downstream side. The number of the slits on the upstream side may be smaller than the number of the slits on the downstream side.

The diffusers arranged along the circumferential direction may be out of the imaginary circle.

When the baffle is in the full close position, the EGR inlet may be overlapped with the inner pipe entirely. When the baffle is in the full open position, the EGR inlet may be away from the inner pipe entirely.

The housing and the end cap may be formed into a housing as a single component.

It should be appreciated that while the processes of the embodiments of the present disclosure have been described herein as including a specific sequence of steps, further alternative embodiments including various other sequences of these steps and/or additional steps not disclosed herein are intended to be within the steps of the present disclosure.

While the present disclosure has been described with reference to preferred embodiments thereof, it is to be understood that the disclosure is not limited to the preferred embodiments and constructions. The present disclosure is intended to cover various modification and equivalent arrangements. In addition, while the various combinations and configurations, which are preferred, other combinations and configurations, including more, less or only a single element, are also within the spirit and scope of the present disclosure.

What is claimed is:

1. An EGR device comprising:

a housing having an outer pipe, the outer pipe defining an EGR inlet and including an inner circumferential surface that defines a housing chamber therein;

a baffle accommodated inside the housing chamber of the outer pipe; and at least one diffuser, wherein the baffle includes an inner pipe defining an inner passage therein, the inner pipe includes an outer circumferential surface that is spaced away from the inner circumferential surface of the outer pipe to define an annular passage between the outer circumferential surface and the inner circumferential surface, the annular passage is in fluid communication with the EGR inlet, and the at least one diffuser extends in the annular passage while being separate from both the inner circumferential surface and the outer circumferential surface, the at least one diffuser includes a plurality of diffusers, the diffusers are circumferentially arranged, the diffusers define slits therebetween, the diffusers form a circular array defining an outer channel together with the inner circumferential surface of the outer pipe and defining an inner channel together with the outer circumferential surface of the inner pipe, and the outer channel communicates with the inner channel through the slits.

2. The EGR device according to claim 1, wherein the inner passage, the inner channel, and the outer channel define three layers radially outward.

3. The EGR device according to claim 1, wherein the EGR inlet is overlapped with at least one of the diffusers.

4. The EGR device according to claim 1, wherein the housing includes a wall extending inward of the housing chamber from the inner circumferential surface of the outer pipe, and the at least one diffuser is affixed to the wall at a fixed end and is free at a free end.

5. The EGR device according to claim 4, wherein the baffle is movable in an axial direction, the baffle has a brim extending radially from an end of the baffle, and the brim is configured to make contact with the free end.

6. The EGR device according to claim 5, wherein the inner pipe is distant from the wall when the brim is in contact with the free end.

7. The EGR device according to claim 1, wherein the baffle is movable in an axial direction, the baffle has a brim extending radially from an end of the baffle, the housing includes a wall extending inward of the housing chamber from the inner circumferential surface of the outer pipe, the brim, the outer pipe, and the wall define a pressure chamber, and the pressure chamber is configured to receive EGR gas from the EGR inlet to apply pressure to the brim and the wall to move the baffle.

8. The EGR device according to claim 1, further comprising:

a brim extending radially from an end of the baffle; and a spring located between a seat and the brim and configured to bias the brim to move the baffle.

9. The EGR device according to claim 1, wherein the circular array is coaxial with the inner pipe.

10. The EGR device according to claim 1, wherein at least one of the diffusers on an upstream side is smaller than at least one of an other of the diffusers.

11. The EGR device according to claim 1, wherein the inner pipe is offset from the outer pipe.

12. The EGR device according to claim 1, wherein at least one of the slits on an upstream side is smaller than at least one of an other of the slits on a downstream side.

13. The EGR device according to claim 1, wherein a number of the slits on an upstream side is smaller than a number of the slits on a downstream side.

14. An EGR device comprising:

a housing having an outer pipe that defines an EGR inlet;

a baffle accommodated in the outer pipe; and at least one diffuser, wherein the baffle has an inner pipe located radially inside the outer pipe, the inner pipe including an inner circumferential surface defining an inner passage therein, and the at least one diffuser extends inside the inner passage of the inner pipe while being separate from the inner circumferential surface of the inner pipe.

15. The EGR device according to claim 14, wherein the baffle includes a brim extending radially inward of the inner pipe, the housing includes a wall extending inward of the outer pipe, the brim, the outer pipe, and the wall define a pressure chamber, and the pressure chamber is configured to receive EGR gas from the EGR inlet to apply pressure to the brim and the wall to move the baffle.

16. An EGR device comprising:

a housing having an outer pipe and a wall, the outer pipe defining an EGR inlet and including an inner circumferential surface that defines a housing chamber therein, the wall extending radially inward of the housing chamber from the inner circumferential surface of the outer pipe;

a baffle accommodated inside the housing chamber of the outer pipe to be movable in an axial direction of the housing; and a spring biasing the baffle, wherein the baffle includes an inner pipe configured to overlap with the EGR inlet radially and defines an opening area of the EGR inlet, which is not overlapped with the baffle, the inner pipe includes an outer circumferential surface that is spaced away from the inner circumferential surface of the outer pipe, and further includes a brim that outwardly protrudes from the outer circumferential surface, the inner circumferential surface, the outer circumferential surface, the wall, and the brim define a pressure chamber in the annular passage that is in fluid communication with the EGR inlet through which EGR gas flows into the annular passage, the brim receives a pressure from EGR gas to move the baffle in a direction to increase the opening area of the EGR inlet, the spring biases the baffle in a direction to decrease the opening area of the EGR inlet, and the baffle changes the opening area of the EGR inlet by moving according to a flow quantity of EGR gas passing through the opening area, thereby maintaining a flow velocity of EGR gas at a constant value.

* * * * *